United States Patent [19]

Epple

[11] 4,299,038

[45] Nov. 10, 1981

[54] SOLE FOR ATHLETIC SHOE

[75] Inventor: Franz Epple, Higerloch, Fed. Rep. of Germany

[73] Assignee: BRS, Inc., Beaverton, Oreg.

[21] Appl. No.: 96,304

[22] Filed: Nov. 21, 1979

[30] Foreign Application Priority Data

Nov. 29, 1978 [DE] Fed. Rep. of Germany ..... 2851571

[51] Int. Cl.[3] ..... A43C 15/00

[52] U.S. Cl. ..... 36/67 D

[58] Field of Search ..... 36/59 R, 67 R, 67 D

[56] References Cited

U.S. PATENT DOCUMENTS 2,292,238 8/1942 Pierce et al. ..... 36/67 D
3,928,881 12/1975 Bente ..... 36/67 D

FOREIGN PATENT DOCUMENTS 2324706 12/1973 Fed. Rep. of Germany ..... 36/59 R
2535624 7/1976 Fed. Rep. of Germany ..... 36/59 R
2618588 11/1977 Fed. Rep. of Germany ..... 36/59 R
2629712 1/1978 Fed. Rep. of Germany ..... 36/59 R

*Primary Examiner*—Patrick D. Lawson
*Attorney, Agent, or Firm*—Schuyler, Banner, Birch, McKie & Beckett

[57] ABSTRACT

A running or jogging shoe having an improved outer sole equipped with replaceable synthetic insert elements having a uniquely contoured shape adapted to be threadedly secured in overlapping relationship to raised projections on the sole exterior. In a first embodiment, the insert elements are adapted to receive and retain conventional spikes. In a second embodiment, the insert elements include integrally formed gripping projections. By replacing worn insert elements, the useful life of the outer sole, and thus the shoe as well, can be extended significantly.

34 Claims, 3 Drawing Figures

SOLE FOR ATHLETIC SHOE

BACKGROUND OF THE INVENTION

The present invention pertains generally to athletic shoes and more particularly to the spiked sole construction of a track shoe of the type employed for running and jogging activities.

It has been a practice in the prior art to provide the soles of track shoes with relatively large threaded cavities for inserting replaceable steel or synthetic spikes. Those skilled in the art will appreciate that detachable threaded spikes permit the useful life of the track shoe to be extended since the spikes themselves tend to wear out much faster than the sole and other parts of the track shoe.

It is a primary object of the present invention to provide an improved sole for an athletic shoe adapted to receive replaceable spikes to permit the useful life of the sole and shoe to be extended.

A particular object of the invention is to provide a sole for an athletic shoe which is equipped with replaceable synthetic elements adapted to carry steel or synthetic spikes or spike-like gripping projections while projecting the sole from excessive wear in the vicinity of the spikes or gripping projections.

In addition to extending the useful life of athletic shoes, the replaceable synthetic elements of the present invention have the advantage of reducing the weight of the shoe in comparison with shoes employing conventional steel spikes.

Other objects and advantages of the invention will become apparent upon consideration of illustrative embodiments thereof described in conjunction with the accompanying drawings.

SUMMARY OF THE INVENTION

In accordance with the present invention, a sole for athletic shoes is provided with a plurality of raised projections each of which has a central cavity of a relatively large diameter with threaded interior walls for receiving a replaceable protective insert element having a specially contoured structure. Each replaceable insert element includes an outer wall which overlaps the portions of the respective raised projection, thereby protecting the raised projections from the wear and tear of use in order to extend the useful life of the sole.

DESCRIPTION OF THE PREFERRED EMBODIMENTS

Figure 1:
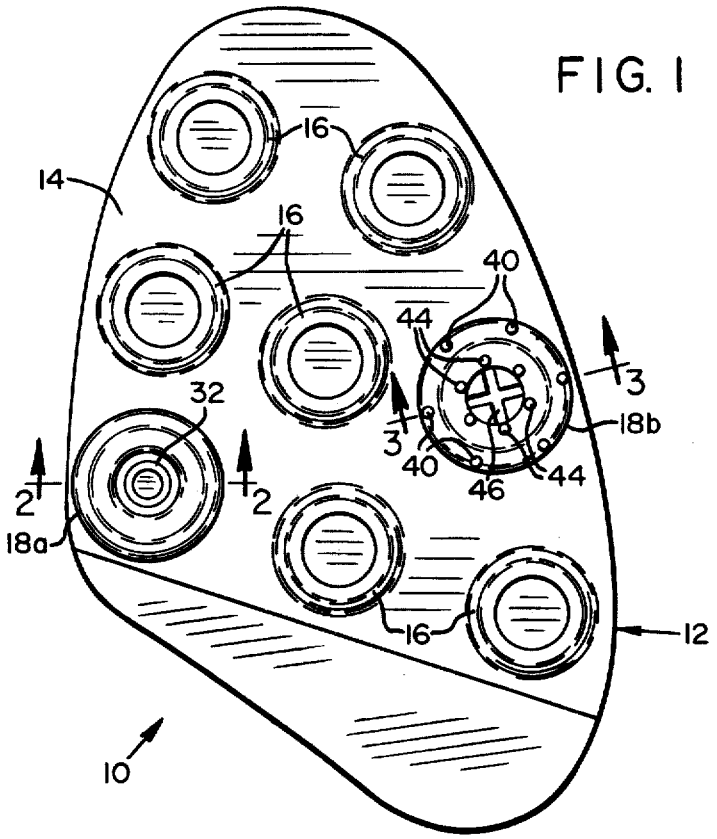
FIG. 1 is a schematic plan view of the outer surfaces of a sole for a track shoe illustrating by way of example two embodiments of replaceable protective insert elements, each being disposed at a selected one of several possible locations on the sole.

Referring to FIG. 1, a sole for use on a track shoe or the like is illustrated and designated generally by reference numeral 10. The sole 10 comprises a sole plate 12 of a moldable polymeric material, suitable examples of which include polymide, polyacetale, polyurethane, polyvinyl chloride, and rubber. The sole plate 12 can be secured to a track shoe (not shown) in accordance with conventional manufacturing techniques. The sole plate 12 has a major exterior surface 14 on which a plurality of generally conial-shaped, raised areas or projections 16 are disposed in a pattern as illustrated by way of example in FIG. 1.

Figure 2:
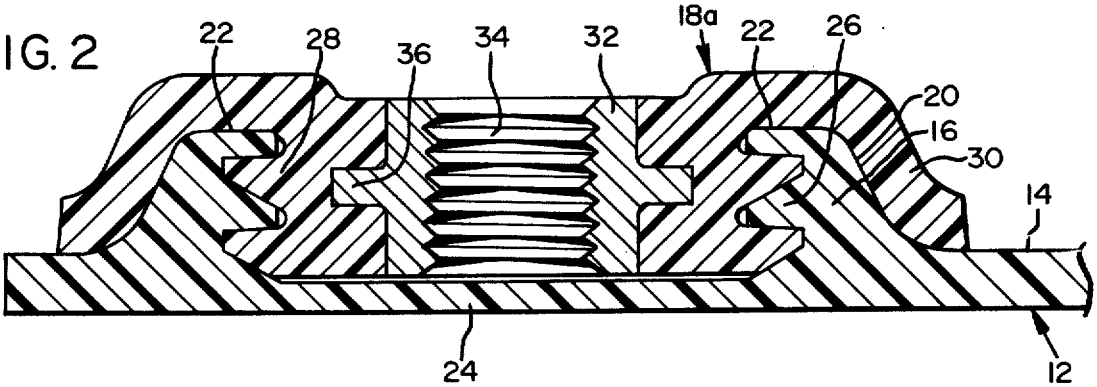
FIG. 2 is a greatly enlarged fragmentary view of a replaceable protective insert element in accordance with a first embodiment of the invention taken in vertical cross section along line 2—2 of FIG. 1.
Figure 3:
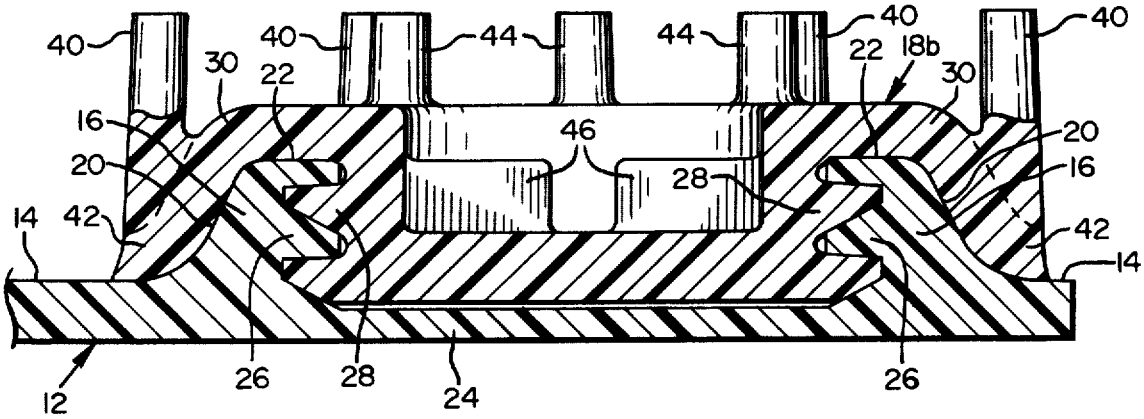
FIG. 3 is a greatly enlarged fragmentary view of a replaceable protective insert element in accordance with a second embodiment of the invention taken in vertical cross section along line 3—3 of FIG. 1.

FIGS. 2 and 3 illustrate first and second embodiments of replaceable protective insert elements, respectively designated by reference numerals 18*a* and 18*b*, each having a uniquely contoured shape, the details and principal purposes of which will be described below. The replaceable insert elements 18*a* and 18*b* preferably are fabricated from the same moldable polymeric material used to fabricate the sole plate 12.

The features of the preferred sole plate 12 and the various common features of the insert elements 18*a* and 18*b* will presently be described with reference to FIGS. 2 and 3, wherein similar parts are designated using the same reference numerals and wherein reference numeral 18 will be used in the generic sense to both elements 18*a* and 18*b*.

The projections 16 are preferably integrally formed portions of the molded sole plate 12. Each projection 16 includes an exterior surface 20 rising from the major exterior surface 14 of the sole plate 12 to an annular rim 22 at an elevation above the major surface 14. It will be understood that terms such as "above" and similar directional terms used in this specification and the appended claims are intended to be construed from the relative point of view of FIGS. 2 and 3. Extending entirely under each projection 16 is a circular base portion 24 of the sole plate 12. Each projection 16 includes an interior wall 26 having sawtooth-shaped threads defining an annular cavity above the base portion 24 and within the annular rim 22.

Each insert element 18 includes an annular wall 28 having outwardly facing sawtooth-shaped threads constructed to mate with the threaded wall 26 to permit insert elements 18 to be installed in the cavities of the projections 16. Each insert element 18 includes an outer wall 30 extending from its respective threaded annular wall 28 to overlap adjacent annular rim 22 and tightly conform to the raised exterior surface 20 of the projection 16 within which the insert element 18 is secured.

Now referring to FIG. 2, the features unique alone to the first insert element embodiment 18*a* will be described. A metal socket 32 having a threaded opening 34 is anchored within the insert element 18*a*. The socket 32 preferably includes at least one anchor member 36 extending radially outward into the insert element 18*a* to firmly secure the metal socket 32 therein. It will be appreciated that the metal socket 32 can be firmly secured within the insert element 18*a* as depicted in FIG. 2 in accordance with conventional insert-molding techniques. The metal socket 32 thus provides an excellent means for securing a replaceable metal spike (not shown) to the sole plate 12 by merely screwing the spike into the threaded opening 34. It will also be appreciated that a specially adapted tool (not shown) can be used to screw the insert element 18*a* into the threaded interior wall 26 or that the replaceable metal spike itself can be used for such purpose.

Now referring to FIG. 3 in conjunction with FIG. 1, the features unique alone to the second insert element embodiment 18b will be described. The insert element 18b includes two circular patterns of integrally molded gripping projections consisting of an outer pattern of gripping projections 40 disposed above a peripheral portion 42 of the outer wall 30 and an inner pattern of gripping projections 44 disposed above the threaded annular wall 28. The gripping projections 40 and 44 are spike-like in appearance and are preferably generally cylindrical in shape as clearly depicted in FIG. 3. It will be appreciated that each outer gripping projection 40 is vertically supported by the portion of the major exterior surface 14 of the sole plate 12 which underlies the peripheral wall portion 42 of the element 18b. In order to effect installation or removal of the insert element 18b from the cavity of its respective projection 16, a cross-shaped recess 46 is provided at the center of the element 18b as seen best in FIG. 1, thereby enabling the element 18b to be screwed into or out of the threaded interior wall 26 using a suitable tool (not shown) such as a phillips screwdriver.

From the foregoing description of the two illustrative embodiments of the replaceable protective insert elements 18, those skilled in the art will appreciate the many advantages afforded by the present invention. For example, it will be readily apparent that the use of a synthetic material for all or most of each insert element 18 in conjunction with the relatively thin contoured shape of each such element 18 provides a sole construction which is extremely light in weight and has a maximized useful life while also exhibiting optimum versatility and performance characteristics. Of particular importance is the overlapping effect of the outer wall 30 of each element 18 in protecting the respective raised projection 16 against the severe wear and tear of use. The protective insert elements 18 can be replaced economically when worn out whereas the raised projections 16 comprise permanent irreplaceable parts of the sole plate 12.

A further significant advantage of the present invention, which can be appreciated from FIG. 1, is that insert elements 18 of different constructions can be employed simultaneously in various patterns in accordance with the desires of the user athlete. For example, the athlete may choose to employ the insert elements 18a of FIG. 2 without spikes at certain selected locations and the insert elements 18b of FIG. 3 at the remaining locations of the raised projections 16 in order to adapt the sole 12 of the shoe to track conditions, the type of athletic event, or numerous other variables. Accordingly, in such an example, there will be elements 18a at some locations extending to one elevation beyond the major surface 14 and elements 18b at other locations extending to another elevation beyond the major surface 14. Furthermore, different types of elements 18 of varying hardness can be employed at different selected locations in accordance with the desires of the athlete, which can be advantageous in reducing the incidence of tendonitis and other running-related injuries.

Although only two embodiments of replaceable insert elements 18 have been specifically illustrated and described in detail, it will be appreciated that many adaptations, modifications and alternatives are contemplated by the present invention. For example, the present invention contemplates the alternative embodiment of a replaceable insert element without a provision for spikes or spike-like gripping projections, such as would be provided by the embodiment of FIG. 3 wherein the gripping projections 40 and 44 are removed. Such a spike-free embodiment might be especially desirable for use on a synthetic track to provide optimum traction and yet having the advantages of replaceability and extended sole life. As a further example, the present invention contemplates an alternative embodiment wherein metal spikes are permanently molded into replaceable synthetic elements, such as would be provided by the embodiment of FIG. 2 modified by replacing the metal socket 32 with a threaded metal spike. Having the benefit of the presently disclosed invention, numerous other alternative embodiments which are within the spirit and scope of the appended claims will be suggested to those skilled in the art.

What is claimed is:

1. A sole for an athletic shoe comprising:

a sole plate having a major exterior surface and a plurality of projections, each projection having a wall extending outward from the major exterior surface to define a plurality of cavities, each of said projections including a threaded interior wall which at least partially defines the respective cavity, a major portion of said threaded interior wall extending outward of said major exterior surface of said sole plate, each projection further including a raised exterior surface extending from the major exterior surface to a peripheral rim of the respective cavity; and a plurality of contoured insert elements for insertion into the cavities of selected ones of said projections, each insert element having a threaded wall with a threaded outwardly facing surface cooperatively constructed to mate with the threaded interior wall of the projections to permit each insert element to be threadedly secured within the cavity of a selected projection with a major portion of said threaded outwardly facing surface disposed outward of said major exterior surface of said sole plate, each insert element having an outer wall extending from its respective threaded wall to overlap and at least partially cover the raised exterior surface of the selected projection when the insert element is secured within the respective cavity.

2. The sole of claim 1 wherein the raised exterior surface of each projection is generally annular in shape and curves outwards from an annular rim portion at the periphery of the cavity to the major exterior surface of the sole plate.

3. The sole of claim 2 wherein the raised exterior surface is further characterized by a conical surface portion extending from the annular rim portion to the major exterior surface of the sole plate.

4. The sole of claim 1 further comprising spike fastener means attached to at least one of said insert elements for securing at least one outwardly extending spike.

5. The sole of claim 4 wherein the spike fastener means comprises a threaded opening for securing a spike within the respective insert element.

6. The sole of claim 5 wherein the insert element comprises a moldable polymeric material and wherein the threaded opening is provided within a metal socket molded within the insert element.

7. The sole of claim 6 wherein the metal socket includes at least one anchor member extending radially outward into the insert element to firmly secure the metal socket therein.

8. The sole of claim 1 wherein at least one of said insert elements comprises a moldable polymeric material and includes at least one integrally molded gripping projection.

9. The sole of claim 8 wherein a plurality of integrally molded gripping projections extend outward in a circular pattern from the respective insert element.

10. The sole of claim 8 wherein a plurality of integrally molded gripping projections are disposed above a peripheral portion of the outer wall which is supported by the major exterior surface of the sole plate.

11. The sole of claim 8 wherein each insert element includes recess means for cooperatively receiving a tool with which said insert element can be installed in or removed from its respective cavity.

12. The sole of claim 1 wherein the insert elements are arranged in a pattern on the sole in which there exist insert elements of at least two different constructions such that insert elements of a first elevation are disposed at first selected locations and insert elements of a second elevation are disposed at second selected locations.

13. The sole of claim 1 wherein the material of the insert elements is selected from the group consisting of polyamide, polyacetale, polyurethane, polyvinyl chloride, and rubber.

14. The sole of claim 13 wherein the material of the sole plate is selected from the group consisting of polyamide, polyacetale, polyurethane, polyvinyl chloride, and rubber.

15. The sole of claim 1, 2 or 3 wherein the outer wall of each insert element has a thickness substantially equal to the thickness of said sole plate, and the outer wall having an outer surface forming a ground engaging surface of the respective insert element.

16. The sole of claim 1 wherein substantially all of said threaded interior wall of each of said projections extends outward of said major exterior surface of said sole plate.

17. The sole of claim 6 wherein a major portion of the threaded opening of said metal socket extends outward of said major exterior surface of said sole plate.

18. The sole of claim 8 wherein a plurality of said at least one intergrally molded gripping projections extend from said insert element in a pair of coaxial circular patterns.

19. A sole for an athletic shoe comprising:

a sole plate having a major exterior surface and a plurality of projections, each projection having a wall extending outward from the major exterior surface to define a plurality of cavities, each of said projections including a threaded interior wall which at least partially defines the respective cavity, substantially all threaded interior wall extending outward of said major exterior surface of said sole plate, each projection further including a raised exterior surface extending from the major exterior surface to a peripheral rim of the respective cavity; and a plurality of contoured insert elements for insertion into the cavities of selected ones of said projections, each insert element having a threaded wall with a threaded outwardly facing surface cooperatively constructed to mate with the threaded interior wall of the projections to permit each insert element to be threadedly secured within the cavity of a selected projection with substantially all of said threaded outwardly facing surface disposed outward of said major exterior surface of said sole plate, each insert element having an outer wall extending from its respective threaded wall to overlap and at least partially cover the raised exterior surface of the selected projection when the insert element is secured within the respective cavity, the outer wall of each insert element having a thickness substantially equal to the thickness of said sole plate, an outer surface of said outer wall forming a ground engaging surface of the respective insert element.

20. A sole for an athletic shoe comprising:

a sole plate having a major exterior surface and projections extending outward from the major exterior surface to define a plurality of cavities, each of said projections including a threaded interior wall which at least partially defines the respective cavity, each projection further including a raised exterior surface extending from the major exterior surface to a peripheral rim of the respectively cavity; and a plurality of contoured insert elements for insertion into the cavities of selected ones of said projections, each insert element having a threaded annular wall cooperatively constructed to mate with the treaded interior wall of the projections to permit each insert element to be threadedly secured within the cavity of a selected projection, each insert element having an outer wall extending from its respective threaded annular wall to overlap and at least partially cover the raised exterior surface of the selected projections when the insert element is secured within the respective cavity, at least one of said insert elements being comprised of a molded polymeric material and having a metal socket molded within it, said metal socket having a threaded opening for threadingly receiving a spike.

21. The sole of claim 20 wherein substantially all of said threaded interior wall of each of said projections is disposed outward of said major exterior surface of said sole plate.

22. The sole of claim 21 wherein substantially all of the threaded opening of said metal socket is disposed outward of said major exterior surface of said sole plate.

23. A sole for an athletic shoe comprising:

a sole plate having a major exterior surface and projections extending outward from the major exterior surface to define a plurality of cavities, each of said projections including a threaded interior wall which at least partially defines the respective cavity, each projection further including a raised exterior surface extending from the major exterior surface to a peripheral rim of the respective cavity; and a plurality of contoured insert elements for insertion into the cavities of selected ones of said projections, each insert element having a threaded annular wall cooperatively constructed to mate with the treaded interior wall of the projections to permit each insert element to be threadedly secured within the cavity of a selected projection, each insert element having an outer wall extending from its respective threaded annular wall to overlap and at least partially cover the raised exterior surface of the selected projection when the insert element is secured within the respective cavity, at least one of said insert elements being comprised of a molded polymeric material and including a plurality of integrally molded gripping projections extending beyond an outer ground engaging surface of said outer wall.

24. The sole of claim 23 wherein said gripping projections are arranged in a circular pattern.

25. The sole of claim 23 wherein said gripping projections are arranged in a pair of co-axial circular patterns, an inner one of said circular patterns being located radially inward of the threaded wall of the insert element from which it extends and an outer one of said circular patterns being located radially outward thereof.

26. The sole of claim 23, 24 or 25 wherein substantially all of said threaded interior wall of each of said projections is disposed outward of said major exterior surface of said sole plate.

27. An insert element for removable attachment to a projection from a sole plate of an athletic shoe comprising:

a member having a threaded wall with a threaded outwardly facing surface adapted to mate with a threaded interior surface of a projection from a sole plate, an upper wall extending radially outward of an upper end of said threaded wall, and a peripheral wall extending radially outward and downward from said upper wall, said peripheral wall extending downward to a level coextensive with substantially all of the threaded outwardly facing surface.

28. The insert element of claim 27 including a threaded opening disposed radially inward of said threaded wall for receiving a spike with mating threads.

29. The insert element of claim 27 wherein said member is formed of a molded polymeric material, and including a metal socket molded to said member radially inward of said threaded wall, said metal socket having a threaded opening for receiving a spike with mating threads.

30. The insert element claim 27 wherein said member is comprised of a molded polymeric material and includes a plurality of integrally molded gripping projections extending beyond an outer ground engaging surface of said upper wall.

31. The insert of claim 30 wherein said gripping projections are arranged in a pair of co-axial circular patterns, an inner one of said circular patterns being located radially inward of the threaded wall and an outer one of said circular patterns being located radially outward thereof.

32. An insert element for removable attachment to a projection from a sole plate of an athletic shoe comprising:

a member formed of a molded polymeric material and having a threaded annular wall with a threaded outwardly facing surface adapted to mate with a threaded interior surface of a projection from a sole plate, an upper wall extending radially outward of an upper end of said threaded wall, and a peripheral wall extending radially outward and downward from said upper wall, said peripheral wall extending downward to a level coextensive with substantially all of the threaded outwardly facing surface; and a metal socket molded to said member radially inward of said threaded wall, said metal socket having a threaded opening for threadingly receiving a spike.

33. An insert element for removable attachment to a projection from a sole plate of an athletic shoe comprising: a member formed of a molded polymeric material and having a threaded annular wall with a threaded outwardly facing surface adapted to mate with a threaded interior surface of a projection from a sole plate, and upper wall extending radially outwardly of an upper end of said threaded wall, and a peripheral wall extending radially outward and downward from said upper wall, said peripheral wall extending downward to a level coextensive with substantially all of the threaded outwardly facing surface, and a plurality of integrally molding gripping projections extending beyond an outer ground engaging surface of said outer wall.

34. The insert element of claim 33 wherein said projections are arranged in at least one circular pattern, and a recess is formed in said member radially inward of said threaded wall, said recess being contoured to mate with a tool.

* * * * *